US007942727B2

(12) United States Patent
Kodaverdian et al.

(10) Patent No.: US 7,942,727 B2
(45) Date of Patent: May 17, 2011

(54) FLOOR EDGER

(75) Inventors: Levik Kodaverdian, La Crescenta, CA (US); R. David Garakanian, Glendale, CA (US); Michael W. Hodges, Parker, CO (US); Rodney Conrad, Arvada, CO (US)

(73) Assignee: Bona AB, Malmo (SE)

( * ) Notice: Subject to any disclaimer, the term of this patent is extended or adjusted under 35 U.S.C. 154(b) by 1459 days.

(21) Appl. No.: 10/638,096

(22) Filed: Aug. 7, 2003

(65) Prior Publication Data

US 2004/0132391 A1 Jul. 8, 2004

Related U.S. Application Data

(60) Provisional application No. 60/402,361, filed on Aug. 8, 2002.

(51) Int. Cl.
*B24B 23/00* (2006.01)
*B24B 27/08* (2006.01)

(52) U.S. Cl. ..... 451/350; 451/353; 451/359

(58) Field of Classification Search ..... 451/350, 451/353, 344, 354, 449, 453, 359, 451, 456, 451/499

See application file for complete search history.

(56) References Cited

U.S. PATENT DOCUMENTS

| | | | | |
|---|---|---|---|---|
| RE21,180 | E * | 8/1939 | Myers | 451/353 |
| 2,544,862 | A * | 3/1951 | Steibel | 451/353 |
| 2,603,919 | A * | 7/1952 | Robinson | 451/353 |
| 4,641,066 | A | 2/1987 | Nagata et al. | |
| 4,922,169 | A | 5/1990 | Freeman | |
| 5,392,568 | A * | 2/1995 | Howard et al. | 451/357 |
| 5,870,791 | A * | 2/1999 | Gurstein et al. | 451/353 |
| 5,890,954 | A * | 4/1999 | Barous | 451/350 |
| 6,027,399 | A * | 2/2000 | Stewart | 451/353 |
| 6,238,277 | B1 * | 5/2001 | Duncan et al. | 451/353 |
| 6,377,008 | B1 | 4/2002 | Hirata | |
| 6,379,126 | B1 | 4/2002 | Konno | |
| 6,380,707 | B1 | 4/2002 | Rosholm et al. | |
| 6,385,395 | B1 | 5/2002 | Horng et al. | |
| 6,388,405 | B2 | 5/2002 | Laurent | |
| 6,396,225 | B1 | 5/2002 | Wakui et al. | |
| 6,407,466 | B2 | 6/2002 | Caamano | |
| 6,414,408 | B1 | 7/2002 | Erdman et al. | |
| 6,420,805 | B1 | 7/2002 | Yamaguchi et al. | |
| 6,447,383 | B2 * | 9/2002 | Oda et al. | 451/357 |
| 6,540,598 | B1 * | 4/2003 | McCutchen | 451/350 |
| 6,616,517 | B2 * | 9/2003 | Palushi | 451/350 |
| 6,935,939 | B1 * | 8/2005 | Buser et al. | 451/451 |

OTHER PUBLICATIONS

International Search Report for PCT/US03/25169 dated Apr. 29, 2004.

* cited by examiner

*Primary Examiner* — Hadi Shakeri
(74) *Attorney, Agent, or Firm* — Klaas, Law, O'Meara & Malkin, P.C.

(57) ABSTRACT

A wood floor edger is disclosed herein. An embodiment of the edger comprises a housing and a motor. The housing comprises an opening and a rotatable abrasive disc located in the opening. The rotatable abrasive disc may have a diameter greater than six inches. The motor is operatively connected to the first housing and drivingly connected to the abrasive disc. A motor controller is electrically connected to the motor, wherein the motor is operatable at a speed that is preselected by the motor controller.

30 Claims, 5 Drawing Sheets

FLOOR EDGER

REFERENCE TO CO-PENDING PROVISIONAL APPLICATION

The benefit of earlier-filed co-pending U.S. Provisional Patent Application Serial No. 60/402,361 filed Aug. 8, 2002 for WOOD FLOOR EDGER, which is hereby incorporated by reference for all that it discloses, is hereby claimed.

BACKGROUND

Floor edgers, sometimes referred to herein simply as edgers, are used to sand or polish floors in the proximity of vertical structures such as walls and base boards. Edgers operate by rotating an abrasive disc that contacts the floor, wherein the rotating abrasive disc polishes or sands the floor. The abrasive disc typically spins at a high speed, such as 3,200 rpm.

Conventional edgers use brush-type electric motors to spin the abrasive disc. The brush-type motors typically operate at a preselected speed or speeds for a given load. The motors may spin faster than the abrasive disc and a reduction device, such as gears, may be located between the motor and the abrasive disc. For example, a brush-type motor may operate at a speed of 10,000 rpm when no load is applied to the abrasive disc, such as when the abrasive disc is not contacting the floor. However, when the abrasive disc experiences a load, such as contacting a floor, the speed of the motor and, thus, the abrasive disc, typically slows down. Depending on the power of the motor, this slow down may be significant enough to reduce the effectiveness of the edger.

In addition to slowing down the speed of the abrasive disc, the loaded condition of the brush-type motor also may cause the motor to draw more current than it draws at a no-load condition. This additional current draw may cause circuits connected to the edger to exceed limits, which may cause circuit breakers to disconnect the circuits and cut power to the edger. Furthermore, the additional current draw may also present safety issues, such as overheating of the edger and the aforementioned circuits connected to the edger.

Another problem with brush-type motors used in edgers is that they are heavy, which causes the edgers to be heavy. Because edgers operate close to the floor, heavy edgers are difficult to maneuver. The heavy edgers may also cause excessive strain on the users of the edgers because the users typically have to bend over or kneel in order to operate the edgers.

SUMMARY

A wood floor edger is disclosed herein. An embodiment of the edger comprises a housing and a motor. The housing comprises an opening and a rotatable abrasive disc located in the opening. The rotatable abrasive disc may have a diameter greater than six inches. The motor is operatively connected to the first housing and drivingly connected to the abrasive disc. A motor controller is electrically connected to the motor, wherein the motor is operatable at a speed that is preselected by the motor controller.

DETAILED DESCRIPTION

Figure 1:
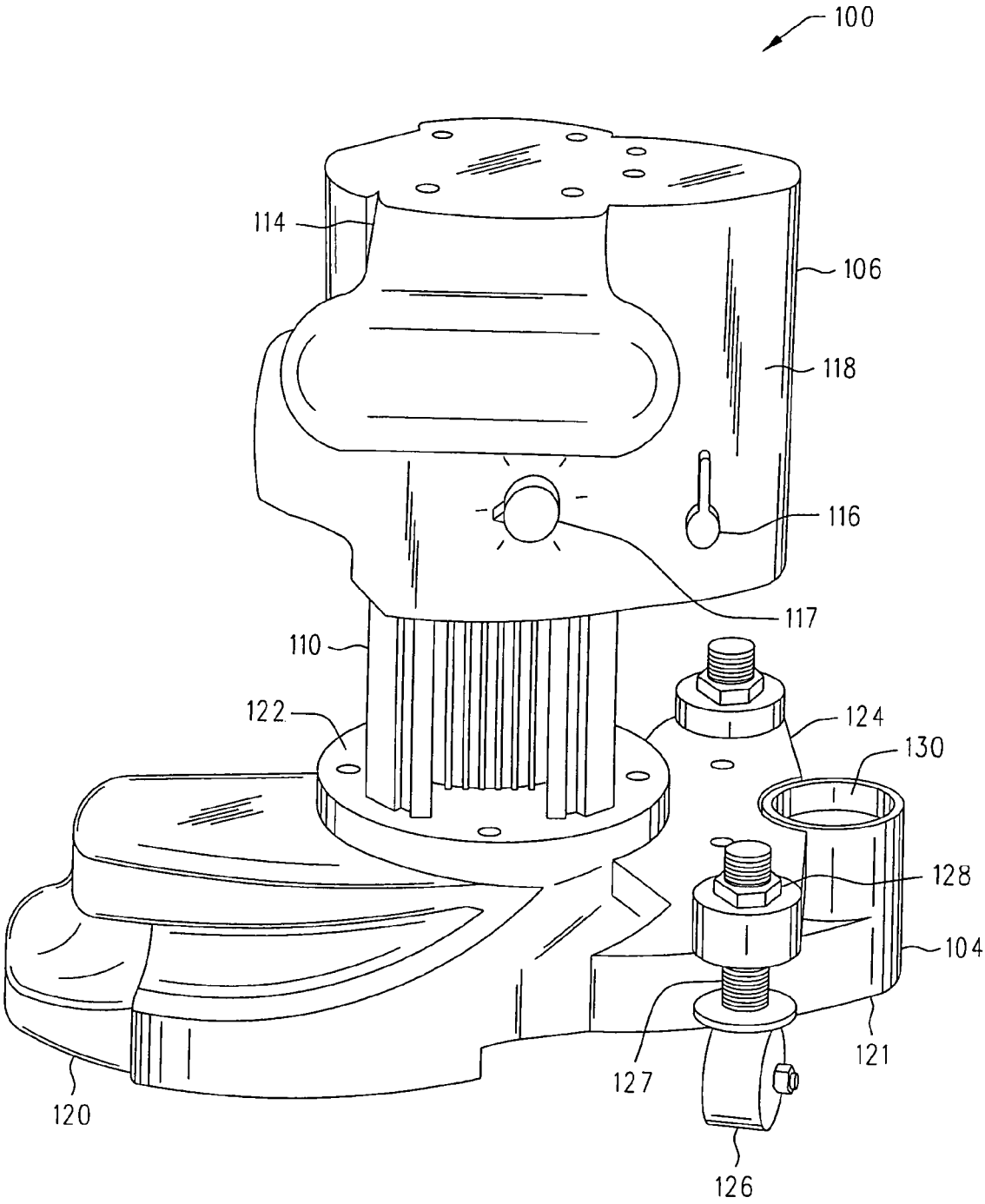
FIG. 1 is a side perspective view of an embodiment of an edger.

An exemplary embodiment of an edger 100 is shown in FIG. 1. As described in greater detail below, the edger 100 may be used to sand a wood floor adjacent a vertical structure, such as a wall or a baseboard. The edger 100 of FIG. 1 includes a lower housing 104 (sometimes referred to as a first housing or a base), an upper housing 106 (sometimes referred to as a second housing), and a motor 110 or motor housing located therebetween. The upper housing 106 may have a handle 114 attached thereto. In addition, a switch 116, a speed control 117, and a power cord 118 may be attached to the upper housing. The upper housing 106 may contain electronics that serve to operate the motor 110 as described in greater detail below.

The handle 114 is adapted to be grasped by a user of the edger 100 in order to control the motion of the edger 100. For example, the handle 114 enables a user to carry the edger 100 and to maneuver the edger 100 against a wall or baseboard that abuts a floor. The power cord 118 serves to provide electric power to the edger 100 and the switch 116 serves to turn the motor off and on. As described in greater detail, the electronics in the upper housing 106 may only enable the motor 110 to run if the switch 116 is toggled. Thus, the motor 110 cannot start if power is applied to the power cord 118. Rather, the switch 116 must be toggled in order for the motor 110 to operate. The speed control 117 may function in conjunction with the electronics and serves to control the rate of rotation of the motor 110 and, thus, the abrasive disc. The electronics associated with the edger 100 are described in greater detail below. It should be noted that the electronics have been described as being located in the upper housing 106, however, the electronics may be located in other portions of the edger 100.

The lower housing 104 has a front portion 120, a rear portion 121, an upper portion 122, and a frame 124 attached thereto. The front portion 120 is adapted to contact a floor that is being sanded or polished. The front portion 120 is also adapted to contact an vertical edge, such as a baseboard or wall, that is located adjacent the floor. The rear portion 121 may be adapted to be located slightly above the floor, which may provide air flow for the removal of dust generated during the sanding process as described in greater detail below. In one embodiment, the lower housing 104 includes a fan (not shown) that is operatively connected to the motor 110 by way of a belt. The fan serves to provide air flow for the removal of dust. The use of a belt reduces maintenance costs associated with the edger and is typically more efficient that a gear driven fan. The upper portion 122 is adapted to receive the motor 110. For example, the shape of the upper portion 122 may match the shape of the motor 110.

The frame 124 serves to support wheels 126, such as caster-type wheels, that are attached to the frame 124. The wheels 126 serve to enable movement of the edger 100 and to maintain the rear portion 121 of the lower housing 104 a preselected distance from the floor. The front portion 120 of the lower housing 104 contacts the floor and, therefore, is not able to move as freely as the rear portion 121. This reduced motion serves to keep the abrasive disc (not shown), which is located in the front portion 120 of the lower housing 104, at a selected location on the floor.

An embodiment of the wheels 126 includes a threaded shaft 127 that is treaded into the frame 124. A lock nut 128 is threaded onto the shaft 127 in order to prevent the shaft 127 from rotating unless the lock nut 128 is loosened. In order to adjust the height of the rear portion 121 of the lower housing 104, the lock nut 128 is loosened. The shaft 127 is then rotated until a desired height of the rear portion 121 is achieved. The lock nut 128 is then tightened in order to prevent the shaft 127 from moving, which maintains the rear portion 121 at the desired height.

A port 130 may be located in the proximity of the rear portion 121. A vacuum device may be connectable to the port 130. For example, a vacuum hose may be connected to the port 130 and may serve to collect dust generated by the edger 100. Airflow passes under the rear portion 121 of the lower housing 104 and through the port 130 to the vacuum device. The above-described fan enhances the air flow so as to enhance dust removal.

Figure 5:
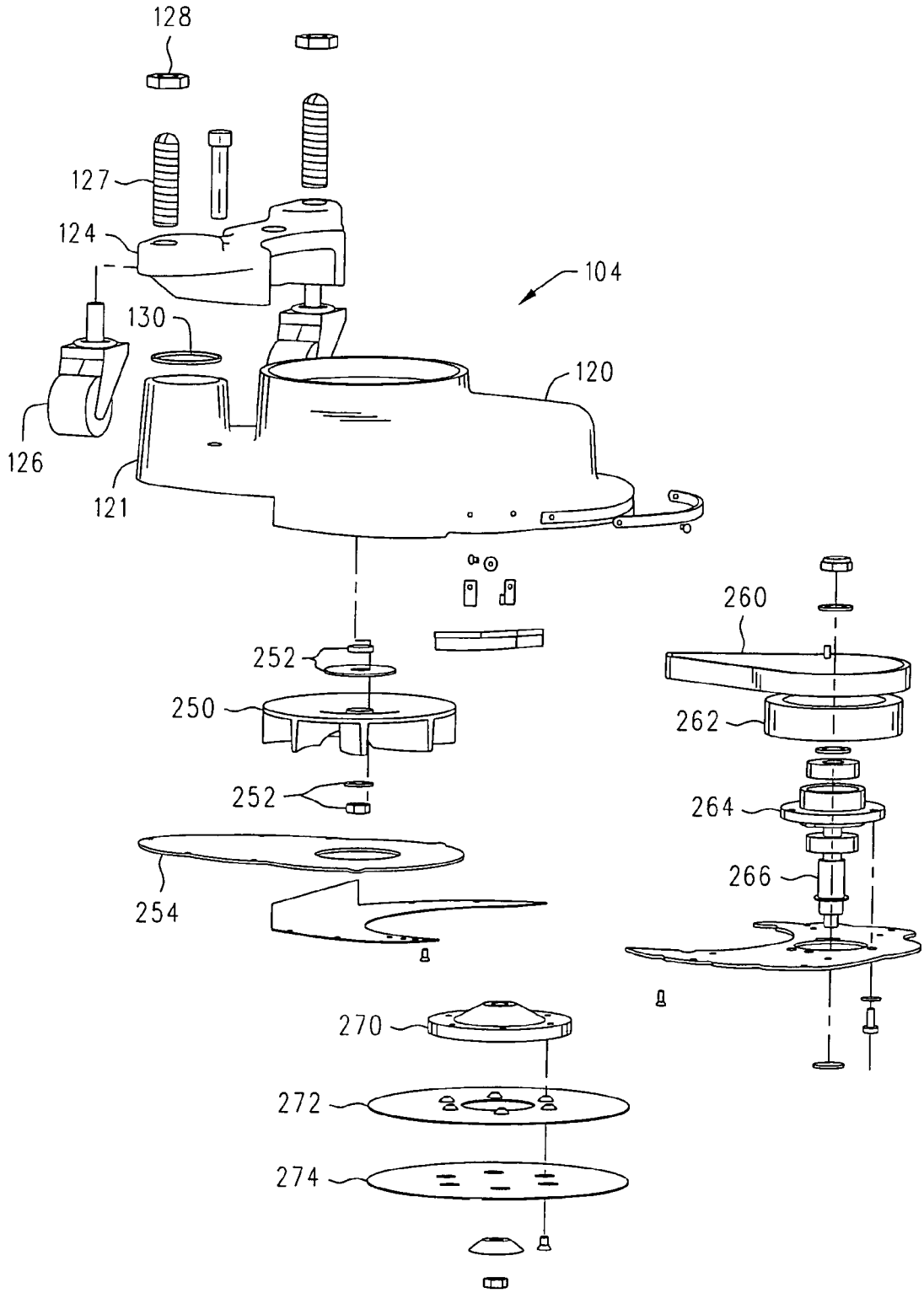
FIG. 5 is a side view of an embodiment of the first housing of the edger of FIG. 1 including some of the components located in the housing.

A more detailed embodiment of the lower housing 104 is shown in FIG. 5. The lower housing 104 includes a fan 250 that may be attached by hardware to the shaft 170, FIG. 3, of the motor 110. A plate 254 may be mounted below the fan. The plate 254 may form a compartment in which the fan 250 is located and may serve to protect the fan 250 and divert air from the opening in the lower housing 104 through the port 130. A belt 260 may also be operatively connected to the shaft 170, FIG. 3. The belt 260 may also be connected to a pulley 262. The pulley 262 may be connected to hardware 264, such as coupling hardware, which may be connected to a shaft 266. The shaft 266 may be connected to a plate 270, which in turn is connected to rotatable sanding discs 272 and 274. Thus, the motor 110, FIG. 3, serves to rotate both the fan 250 and the rotatable discs 272, 274, which are located in the lower housing 104.

Examples of the motor 110 include a brushless motor and a permanent magnet motor. Both of these examples of motors serve to reduce the weight of the edger 100 relative to edgers having conventional brush-type motors. For example, the edger 100 may weigh less than twenty-eight pounds. One embodiment of the edger 100 weighs about twenty-seven pounds. The brushless motor also requires less current than a brush motor when operating at the same speed or providing the same horsepower as a brush-type motor. In one embodiment, the motor 110 provides approximately 2.4 horsepower.

Having described the components of an embodiment of the edger 100, the various components of the edger 100 will now be described in greater detail.

Figure 2:
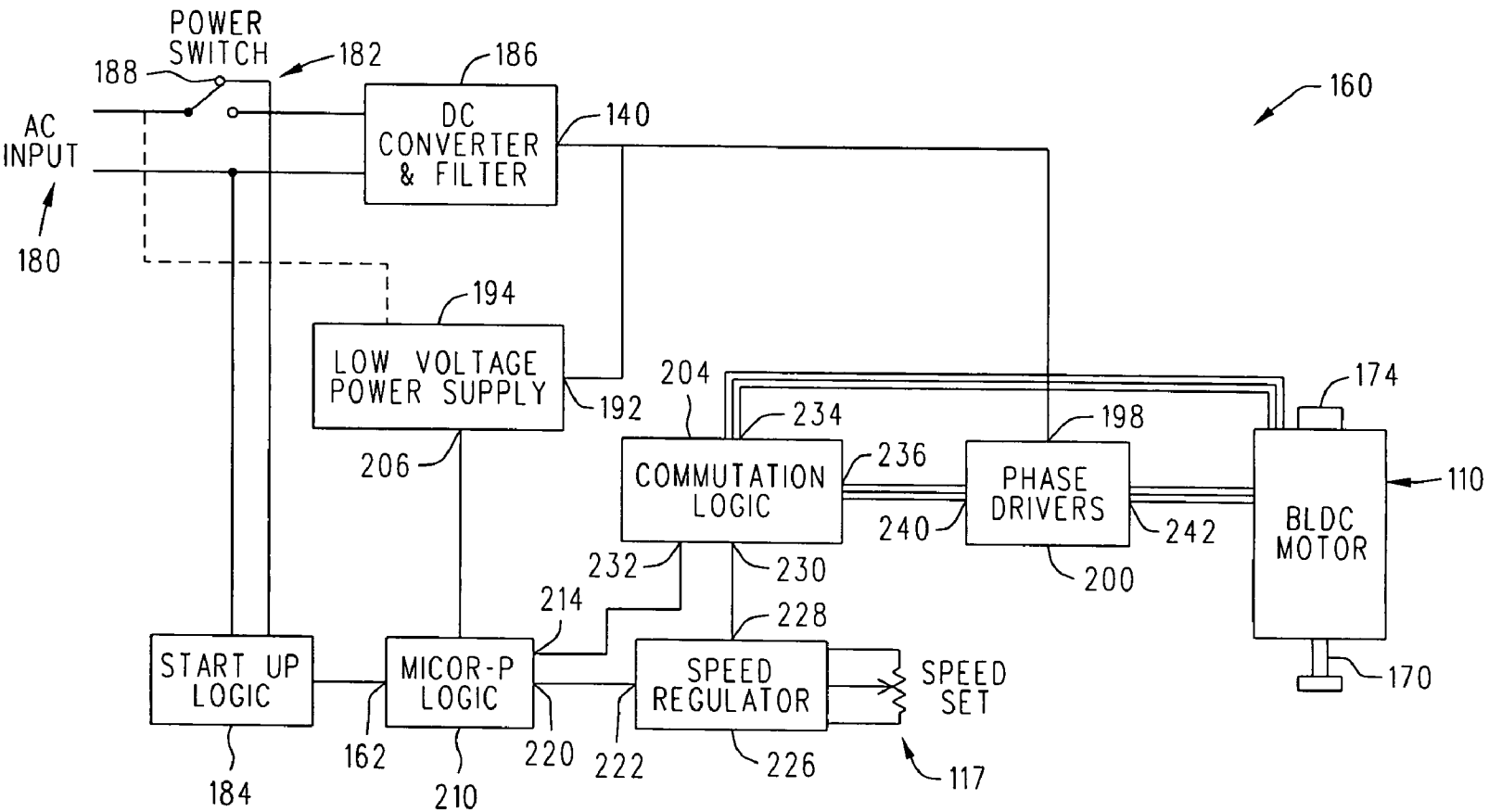
FIG. 2 is schematic diagram providing an embodiment of the electronic in the edger of FIG. 1.

The upper housing 106 may include electronic devices and the like that serve to operate the motor 110. The electronic devices may include a motor controller 160 as shown in FIG. 2. The motor controller 160 serves to supply power to the motor and to regulate the operation of the motor 110. As described above, the motor 110 may, as an example, be a brushless motor. Accordingly, the electronic devices may supply direct current power to the brushless motor.

The use of brushless motor has many benefits over a brush-type motor. For example, a brushless motor provides greater power over a brush-type motor. In addition, the brushless motor 110 does not have brushes that may wear or become contaminated as with a brush-type motor. A brushless motor maintains a more constant speed under loaded conditions than a brush-type motor. Examples of brushless motors are provided in the following U.S. patents, which are all hereby incorporated by reference for all that is disclosed therein: U.S. Pat. Nos. 6,414,408; 6,407,466; 6,396,225; 6,388,405; 6,385,395; 6,380,707; 6,379,126; 6,377,008; 6,420,805; 4,922,169; and 4,641,066.

One non-limiting embodiment of a motor 110 operates at approximately 10,500 revolutions per minute (rpm) at approximately 2.2 horsepower. The motor 110 may draw approximately three amperes under no load conditions. The motor 110 may draw approximately seven to eight amperes under normal load conditions and approximately twelve amperes under heavy load conditions. Therefore, the edger 100 may operate from a conventional one-hundred ten volt, fifteen ampere outlet. Under these conditions, the abrasive disc operates at approximately three-thousand two-hundred rpm. The power may be supplied to the motor 110 by a direct current (DC) power supply located in the upper housing 106 that generates approximately one-hundred sixty volts DC.

Figure 3:
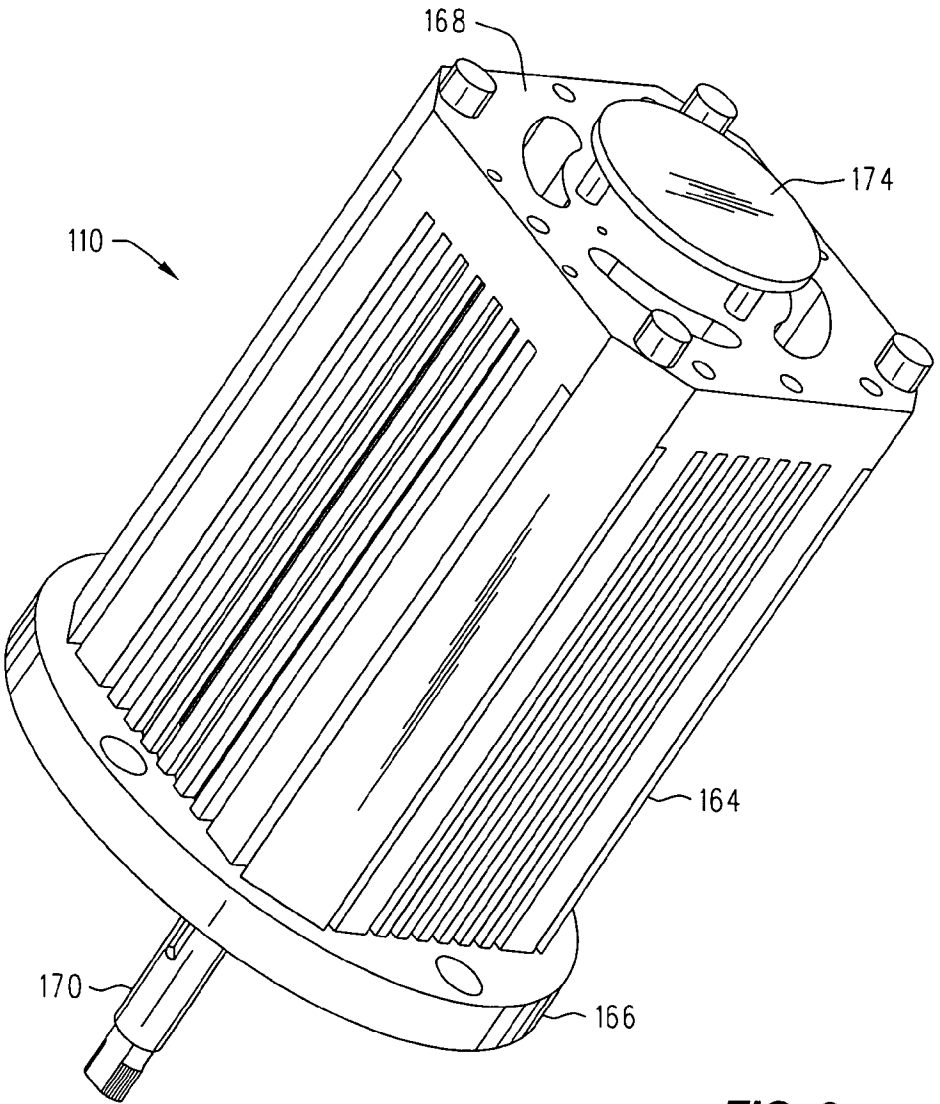
FIG. 3 is a perspective view of an embodiment of the motor of FIG. 1.

An embodiment of the motor 110 is shown in FIG. 3. The motor 110 may have a housing 164 with an end bell 166 attached thereto. The housing 164 may be substantially closed, so as to prevent contaminants from interfering with the operation of the motor 110. The end bell 166 may serve to secure the housing 164 to other portions of the edger 100, FIG. 1. For example, the end bell 166 may attach to the upper portion 122, FIG. 1, of the lower housing 104. The motor 110 may have an end 168 located opposite the end bell 166 to which other components of the edger 100, FIG. 1, may be attached. For example, the upper housing 106, FIG. 1, may be attached to the end 168. A shaft 170 may extend from the housing 164 and through the end bell 166. The shaft 170 may be operatively attached to a abrasive disc or the like (not shown) that are located in the lower housing 104. The shaft 170 may also be connected to or at least operatively connected to the above-described fan (not shown).

A circuit 174 may be located proximate the end 168 and may serve to monitor the operation of the motor 110. The circuit 174 may have contacts or other connections that serve to electrically connect the circuit 174 to other components within the motor controller 160, FIG. 2, as described in greater detail below. For example, the circuit 174 may monitor the speed of the shaft 170 in addition to the amount of current being drawn by the motor 110. In one embodiment, electric power supplied to the motor 110 is supplied via the circuit 174.

Figure 4:
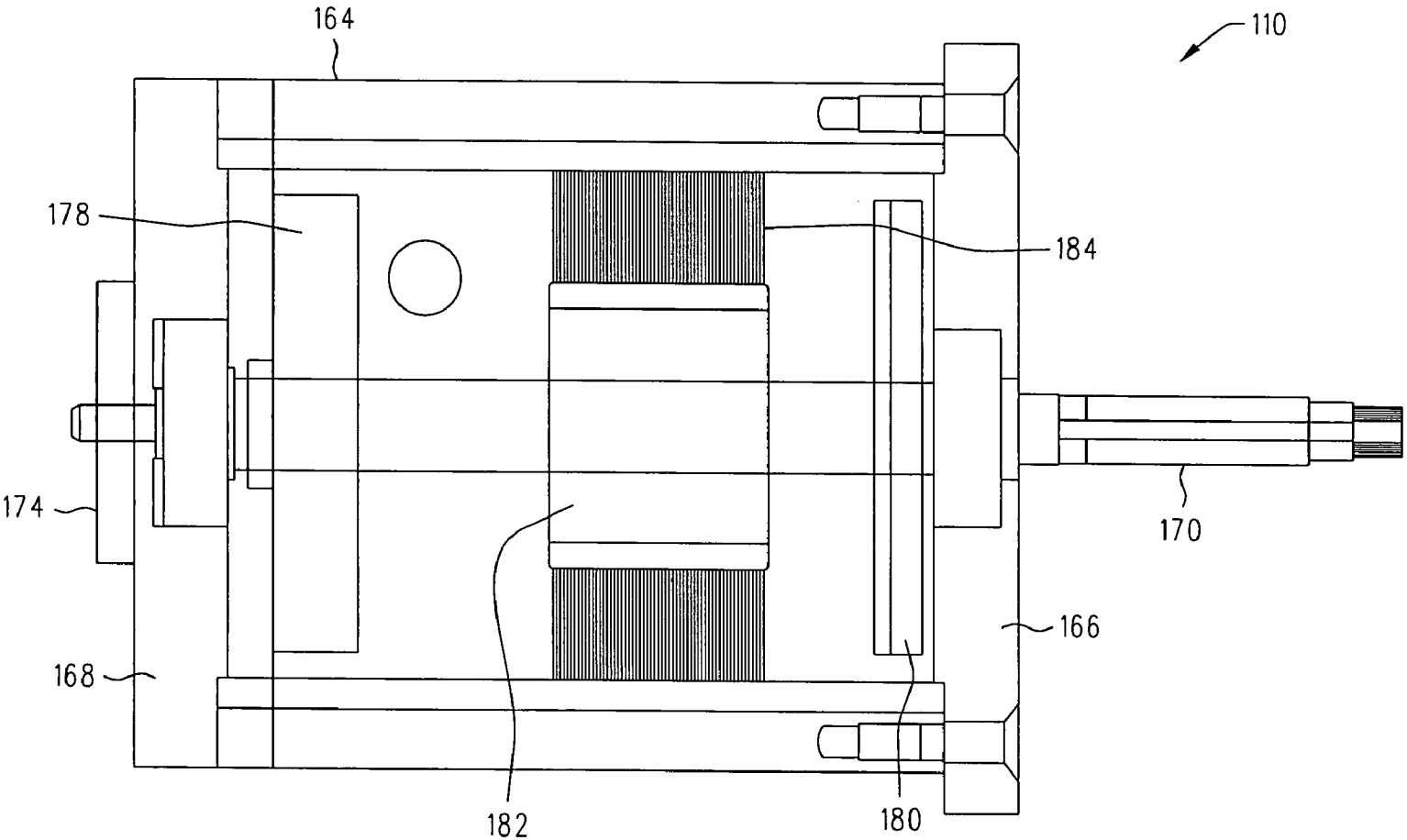
FIG. 4 is a side cut-away view of the motor of FIG. 3.

A side-cut away view of an embodiment of the motor 110 is shown in FIG. 4. The motor 110 depicted in FIG. 4 is a brushless motor. The motor 110 may have a first fan 178 and a second fan 180 connected to the shaft 170 and located within the housing 164. The fans 178 and 180 serve to cool the motor 110. The use of two fans serves to improve the cooling capability significantly over an embodiment using no fans or a single fan.

At least one magnet 182 is attached to the shaft 170. At least one field winding 184 is attached to the housing 164 in the proximity of the magnet 182. The current flow through the field winding 184 is controlled by the motor controller 160, FIG. 2, and serves to control the speed of the shaft 170. For example, the motor controller 160 may monitor the speed of the shaft 170 via the circuit 174 and adjust the current to the field winding 184 so as to maintain the speed of the shaft 170 regardless of the load experienced by the motor 110.

Having described the motor 110, the other components of the motor controller 160 will now be described.

Referring again to FIG. 2, the motor controller 160 may have an input 180 that may be connected to a conventional alternating current (AC) voltage source. One such source may provide approximately one-hundred ten volts at approximately twelve amperes when the motor 110 is operating under its maximum load. Accordingly, the edger 100, FIG. 1, is able to operate on most standard one-hundred ten volt circuits without causing circuit breakers to trip.

The input 185 is electrically connected to a switch 186, which may be operatively connected to the switch 116 if FIG. 1. Depending on the state of the switch 186, the input 185 is either connected to a logic circuit 187 or a DC converter 188. In summary, the logic circuit 187 detects the state or transition of the switch 186 prior to instructing other components within the motor controller 160 to operate. This prevents the motor 110 from operating unless the switch 186 is toggled. For example, the logic circuit 187 may detect the voltage provided by the input 185. In the embodiment described herein, the voltage at the DC converter 188 is required to transition from a low voltage to a high voltage in order for the other components within the motor driver 160 to operate. This transition assures that the motor 110 will only operate when the switch 186 has transitioned from an off position to an on position. Thus, the motor 110 will not start if power is supplied at the input 185 when the switch 186 is in the on position. It should be noted that the switch 186 as shown in FIG. 2 is in an off position.

One embodiment of the logic circuit 187 detects the voltage supplied at the input 185 by way of a contact 188 within the switch 186. The voltage level at the contact 188 will be high when power is supplied to the input 185 and the switch is in the off position. When the switch 186 is toggled to the on position, the voltage level at the contact 188 will transition to a low voltage. Upon the transition from the high voltage level to the low voltage level, the logic circuit 187 may output a signal or instruction that enables other components within the motor controller 160, including the motor 110, to operate.

If the switch 186 is in the on position when power is supplied to the input 185, the voltage level at the contact 188 will be low. Accordingly, the voltage level at the contact 188 will not transition from a high voltage to a low voltage. The lack of such a transition will prevent the logic circuit 187 from enabling other components in the motor driver 160 to operate. Accordingly, the motor 110 will not operate. However, operation of the motor controller 160 may be enabled by toggling the switch 186 to the off position and then to the on position. This toggling will generate the high to low voltage level on the contact 188 that is required in order for the logic circuit 187 to enable the operation of the motor controller 160.

The DC converter 188 converts AC power supplied at the input 185 of the motor controller 160 to DC power for use by the motor 110 and other components in the motor controller 160. The DC converter 188 may have an output 190 which serves as an output for the DC power. The DC voltage may, as an example be, approximately one-hundred sixty volts and the current may be up to twelve amperes depending on the load on the motor 110.

The DC power supplied by the DC converter 188 is supplied to an input 192 of a low voltage power supply 194 and an input 198 of a phase drivers circuit 200. It should be noted that DC power may be supplied to other components (not shown) within the motor controller 160. As described in greater detail below, the phase drivers circuit 200 in conjunction with commutation logic 204 serves to supply electric power to the motor 110.

The low voltage power supply 194 converts the DC voltage supplied by the DC converter 188 to a level more appropriate for low voltage components within the motor controller 160. In the embodiment described herein, the low voltage power supply 194 has an output 206 that is electrically connected to the commutation logic 204 and microprocessor logic 210. The low voltage power supply 194 may, as an example, be a switching power supply and may supply five volts DC.

The microprocessor logic 210 serves to control the operation of the motor 110. For example, the microprocessor logic 210 may ultimately control the speed of the shaft 170, including providing a slow start up speed. The microprocessor logic 210 may also cause power to be removed from the motor 110 in the event that the shaft 170 is unable to rotate. For example, if the shaft 170 or the abrasive disc (not shown) become jammed, the microprocessor logic 210 may cause power to be disconnected from the motor 110.

The microprocessor logic 210 may have a first input 212 that is electrically connected to the logic circuit 187. In one embodiment, the microprocessor logic 210 may have a second input 214 that is electrically connected to the commutation logic 204 as described in greater detail below. An output 220 of the microprocessor logic 210 may be electrically connected to an input 222 of a speed regulator 226. It should be noted that the output 220 of the speed regulator 226 and the input 222 of the speed regulator 226 may, in some embodiments provide two-way communications between the microprocessor logic 210 and the speed regulator 226.

The speed regulator 226 in combination with the speed control 117 provides for a user to set the speed at which the shaft 170 and, thus, the abrasive disc, spins. The speed regulator 226 may have an output 228 that outputs signals or data to an input 230 of the commutation logic 204. As described in greater detail below, the user may adjust the speed control 117 in order to set the speed of the shaft 170. As also described in greater detail below, the speed of the shaft 170 remains substantially constant as the physical load on the shaft 170 varies. Feedback within the motor controller 160 monitors the speed of the shaft 170 and compares it to the speed set by the speed regulator 226. The motor controller 160 then adjusts the speed of the shaft 170 so that it corresponds to the speed established by the speed regulator 226.

The commutation logic 204 monitors the data and other signals generated by the circuit 174 and generates data or other signals to control the speed of the shaft 170. The input 230 of the commutation logic 204 is connected to the output 228 of the speed regulator 226 and an output 232 is connected to the second input 214 of the microprocessor logic 210. The commutation logic 204 also has multiple inputs 234 from the motor 110 and multiple outputs 236 connected to the phase drivers circuit 200. The inputs 234 may be electrically connected to the circuit 174 and may carry data regarding the performance of the motor 170. The outputs 236 carry data indicating the current that is to be supplied to the motor 110 by the phase drivers 200 as described in greater detail below.

The phase drivers 200 has multiple inputs 240 connected to the multiple outputs 236 of the commutation logic 204. The phase drivers 200 also have multiple outputs 242 connected to the motor 170. The phase drivers 200 supply electric power to the motor 110 depending on signals or voltage levels at the multiple inputs 240. The power is supplied to the motor 110 via the multiple outputs 242. Therefore, low power supplied by at the multiple inputs 240 can regulate high power output at the multiple outputs 242.

Having described the components of the motor controller 160, its operation will now be described.

As described above, the logic circuit 187 determines whether the motor 110 may rotate depending on the state of the switch 186. If the logic circuit 187 determines that the motor 110 may rotate, a signal is provided to the microprocessor logic 210 to active the motor 110. The microprocessor logic 210 senses that the motor 110 is being started from a stopped position and outputs a signal via the output 220 to the speed regulator 226, which causes the speed of the motor 110 to start slow and increase to a speed established by the setting of the speed control 117. The slow start of the motor 110 serves to attenuate power surges on the components of the motor controller 160. In addition, the slow start of the motor 110 reduces the initial torque on the edger 100, which lessens the possibility that a user will suddenly lose control of the edger 100 during start up.

The speed information regarding the speed at which the motor 110 is to operate is transmitted to the commutation logic 204 by way of the output 228. For example the speed information may correspond to a voltage or a binary number output at the output 228 of the speed regulator 226. Thus, during start up, the output 220 of the microprocessor logic 210 causes the speed regulator 226 to output a slow speed instruction to the commutation logic 204. The speed may increase as a ramp function until the speed established by the speed control 117 is achieved.

The commutation logic 204 outputs voltages or other signals on the outputs 236, which causes the phase drivers 200 to output voltages on the outputs 242. These voltages or signals correspond to the speed and/or power requirements of the motor 110. The inputs 234 to the commutation logic 200 receive information regarding the status of the shaft 170 and the motor 110. For example, the shaft speed and amount of current drawn by the motor 110 may be output to the commutation logic 204, which may transmit this data to the microprocessor logic 210. Therefore, the microprocessor logic 210 may monitor the motor, including the speed of the shaft 170 as it encounters various loads and may cause the commutation logic 204 to increase or decrease the voltage output by the outputs 242 accordingly. Therefore, the speed of the shaft 170 is maintained relatively constant under varying loads.

Should the commutation logic 204 detect that the shaft 170 is stationary and that high current is being supplied to the motor 110, the commutation logic 204 may disable the phase drivers 200. This disabling is due to the detection of the shaft 170 being jammed or overloaded. Accordingly, the motor 110 will shut down. If the motor 110 were to continue to receive electric power, it could overheat or cause other components in the motor controller 160 to overheat.

What is claimed is:

1. A wood floor edger comprising:

a first housing comprising a first opening, a second opening, a third opening, and a rotatable abrasive disc located proximate said first opening, said rotatable abrasive disc having a diameter greater than six inches;

a motor at least partially located in said second opening and drivingly connected to said abrasive disc;

a fan located in said first housing, said fan being drivingly connected to said motor; and an air path extending between said first opening and said third opening by way of said fan.

2. The wood floor edger of claim 1, wherein said rotatable abrasive disc has a diameter of about seven inches.

3. The wood floor edger of claim 1, wherein the weight of said wood floor edger is about twenty-seven pounds.

4. The wood floor edger of claim 1, wherein said motor is rotatable at a speed of greater than ten-thousand revolutions per minute.

5. The wood floor edger of claim 1, wherein said motor is rotatable at a speed of about ten-thousand five-hundred revolutions per minute.

6. The wood floor edger of claim 1, wherein said abrasive disc is rotatable at a speed of about three-thousand two-hundred revolutions per minute.

7. The wood floor edger of claim 1, wherein said motor has horsepower greater than two.

8. The wood floor edger of claim 1, wherein said motor has horsepower of about 2.4.

9. The wood floor edger of claim 1, wherein said motor is connected to said rotatable abrasive disc by a belt.

10. The wood floor edger of claim 9, wherein said third opening is located adjacent said fan and wherein a vacuum device is attachable to said third opening.

11. The wood floor edger of claim 1, wherein said fan is located within a compartment within said first housing.

12. The wood floor edger of claim 1, and further comprising at least one wheel attached to said first housing.

13. The wood floor edger of claim 1, and further comprising a second housing having a handle attached thereto.

14. The wood floor edger of claim 13, wherein said handle is located opposite said opening of said first housing.

15. A wood floor edger comprising:

a first housing comprising a first opening, a second opening, a third opening, and a rotatable abrasive disc located adjacent said first opening;

a motor at least partially located in said second opening and drivingly connected to said abrasive disc;

a fan located in said first housing and proximate said third opening, said fan being drivingly connected to said motor;

an air path extending between said first opening and said third opening by way of said fan; and a motor controller electrically connected to said motor;

wherein said motor is operatable at a speed that is preselected by said motor controller.

16. The wood floor edger of claim 15, wherein said rotatable abrasive disc has a diameter of about seven inches.

17. The wood floor edger of claim 15, wherein the weight of said wood floor edger is about twenty-seven pounds.

18. The wood floor edger of claim 15, wherein said motor is rotatable at a speed of greater than three thousand revolutions per minute.

19. The wood floor edger of claim 15, wherein said motor is rotatable at a speed of about ten-thousand five-hundred revolutions per minute.

20. The wood floor edger of claim 15, wherein said motor has horsepower greater than two.

21. The wood floor edger of claim 15, wherein said motor has horsepower of about 2.4.

22. The wood floor edger of claim 15, wherein said motor is connected to said rotatable abrasive disc by a belt.

23. The wood floor edger of claim 15, wherein said fan is located within a compartment within said first housing.

24. The wood floor edger of claim 15, wherein a vacuum device is attachable to said third opening.

25. The wood floor edger of claim 15, and further comprising at least one wheel attached to said first housing.

26. The wood floor edger of claim 15, and further comprising a second housing having a handle attached thereto.

27. The wood floor edger of claim 26, wherein said motor is located between said first housing and said second housing.

28. The wood floor edger of claim 26, wherein said handle is located opposite said second opening of said first housing.

29. The wood floor edger of claim 1, wherein said wood floor edger has a weight of less than twenty-eight pounds.

30. The wood floor edger of claim 1, wherein said motor is a brushless motor.

* * * * *